US005379471A

United States Patent [19]

Holdredge

[11] Patent Number: 5,379,471

[45] Date of Patent: * Jan. 10, 1995

[54] PNEUMATIC WHEEL CHAIR CUSHION FOR REDUCING ISCHEMIC INJURY

[76] Inventor: Terry K. Holdredge, 346 Town Creek Dr., Anderson, S.C. 29621

[ * ] Notice: The portion of the term of this patent subsequent to Mar. 16, 2010 has been disclaimed.

[21] Appl. No.: 29,832

[22] Filed: Mar. 11, 1993

Related U.S. Application Data

[63] Continuation-in-part of Ser. No. 647,031, Jan. 28, 1991, Pat. No. 5,193,237.

[51] Int. Cl.[6] ..... A47C 27/08

[52] U.S. Cl. ..... 5/456; 5/453; 5/654; 5/914; 297/DIG. 8

[58] Field of Search ..... 5/453, 455, 456, 469, 5/654, 653, 914, 933, 934; 297/DIG. 3, DIG. 8, 284.1; 137/625.11, 625.13, 625.18; 91/35, 39, 40, 279

[56] References Cited

U.S. PATENT DOCUMENTS

| | | | |
|---|---|---|---|
| 2,278,246 | 3/1942 | Cordova . | |
| 4,197,837 | 4/1980 | Tringali . | |
| 4,279,044 | 7/1981 | Douglas . | |
| 4,553,566 | 11/1985 | Barclay . | |
| 4,622,706 | 11/1986 | Takeuchi . | |
| 4,722,105 | 2/1988 | Douglas . | |
| 4,864,671 | 9/1989 | Evans | 5/455 |
| 5,044,029 | 9/1991 | Vrzalik | 5/455 |
| 5,052,067 | 10/1991 | Thomas | 5/453 |
| 5,117,518 | 6/1992 | Schild | 5/914 |

FOREIGN PATENT DOCUMENTS 1459259 10/1965 France .

*Primary Examiner*—Flemming Saether
*Attorney, Agent, or Firm*—Cort Flint

[57] ABSTRACT

A pneumatic cushion for a wheel chair and the like is disclosed which comprises an air housing box, a plurality of air opening sin the air housing box, and a plurality of air channels communicating with an air supply the air channels communicate with the air openings to deflate and inflate individual air sacks carried over the air openings. The air sacks are unattached so that they act individually. An air distribution manifold includes a rotating blocking member to periodically block air distribution to the air sacks allowing them to deflate. The air sacks are unattached so that they act individually. An air distribution manifold includes a rotating blocking member to periodically block air distribution to the air sacks allowing them to deflate. The air sacks are constructed from a fabric having a low air permeability. The blocked air sacks thus allow air to escape through the sacks for deflation which cools the portion of the occupant seated on the cushion while allowing temporary pressure relief during deflation. The air sack inflation system is open so that, in addition, pressure may be relieved by a backward flow of air through the system. For this purpose, the blocking member which selectively blocks air flow to the air sacks, is in the form of a one-way valve which blocks air in a first direction, but opens in a second direction to allow a bleed-off of air from the sacks should excessive pressures exist in the sacks such as caused by an occupant's weight shift and the like.

24 Claims, 5 Drawing Sheets

PNEUMATIC WHEEL CHAIR CUSHION FOR REDUCING ISCHEMIC INJURY

This is a continuation-in-part of application Ser. No. 647,031 filed on Jan. 28, 1991, which is now issued U.S. Pat. No. 5,193,237.

BACKGROUND OF THE INVENTION

The invention is directed to a pneumatic wheel chair cushion having a dynamic pressure relieving system for reducing ischemic injury to the weight bearing portions of the buttocks of a patient in a sitting position.

With the increasing number of wheel chair patients, the need for wheel chair cushions which provide for greater prevention of ischemic injury are needed. Typically, wheel chair cushions have been provided in various forms and shapes cut from foam. Other wheel chair cushions have been provided which include air cushions. U.S. Pat. No. 4,864,671 discloses a controllably inflated wheel chair cushion that includes a number of independently inflatable rows of cells. The cells are inflated and deflated according to a sequence selected by the user to selectively relieve pressure against the buttocks of the patient. The cells are inflated at a predetermined pressure and may not be deflated until a valve is opened to exhaust the cell. The cells are exhausted through a manifold which delivers air between the cells in order to supply fresh air and reduce the heat from the cushion. However, the system may not satisfactorily compensate a patient's weight causing excessive pressure on inflated portions. U.S. Pat. No. 4,852,195 discloses a similar fluid pressurized cushion which utilizes air cells arranged in a matrix. The air cells are inflated and deflated in a sequence to shift body support from one set of cells to another for promoting blood circulation and comfort. The cells in each matrix may also be interconnected to shift fluid pressure as the patient's weight may shift. While the above air cushions deflate to periodically alleviate pressure against the occupant's buttocks, the air cells are generally static and closed by valves and may not suitably allow pressure to be automatically relieved in instances where the patient's body weight shifts. The pressurized cushions are alternating, but are static. While the air cells or cushions are filled and pressurized with air, that pressure cannot change until the air pressure is released. This may not be satisfactory for severe cases of amputated wheel chair patients whose lower stump is very susceptible to acute ischemic injury and skin decay.

Accordingly, an object of the present invention is to provide an pneumatic wheel chair cushion having a dynamic air distribution system which periodically relieves pressure on portions of the occupant's buttocks.

Another object of the invention is to provide a pneumatic cushion having a dynamic air distribution system which is self regulating and adjusts to the shift in weight of the occupant to automatically relieve pressure and prevent ischemic injury.

Another object of the present invention is to provide a pneumatic cushion for a wheel chair and the like which utilizes individual air sacks which are inflated and deflated in a sequence to periodically reduce pressure against portions of the occupant's buttocks wherein the air sacks are controlled by a dynamic air pressurization system which allow a back flow of air to bleed from the air sacks under excessive pressure to prevent ischemic injury.

Another object of the present invention is to provide a pneumatic cushion for a wheel chair and the like which uses individual air sacks arranged in a matrix which can be alternately inflated and deflated wherein the fabric of the air sacks has a low air permeability which allows a certain amount of the air to escape to maintain the cushion dry and also to assist in automatically regulating the air pressure to shift in occupant's weight.

SUMMARY OF THE INVENTION

The purpose of this invention is to prevent ischemic injury to the weight bearing portions of the buttocks while in a sitting position. This object is accomplished by providing an air cushion having a number of individual air sacks or cells arranged in a matrix which are not physically connected with one another so that they act independently. Reduced air flow and therefore reduced pressure is provided within the cushion periodically so each air sack on the surface will have reduced pressure and reduced flow for 12 seconds every minute, for example, dependent on a clock motor. An air distribution is provided which at any time, is self-regulating because if pressures increase when the occupant shifts their weight or the like, the system automatically buffers the area of exerted weight by a back flow of air to a blower when the pressure of the occupant exceeds the pressure in that cushion. The cushion is self-adjusting, and prevents acute trauma to an area. The air distribution system and cushion allow spontaneous, automatic adjustment in pressure just from the patient shifting his weight so that it minimizes the potential for soft tissue injury at any point in time. There is no closed valve in the system during the inflation cycle. The system is a dynamic pressure and flow pressure system. The air system is continually being charged so that if it is overcome by weight shifts, the air pressure is bled back or outward through the pores in the air sack.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
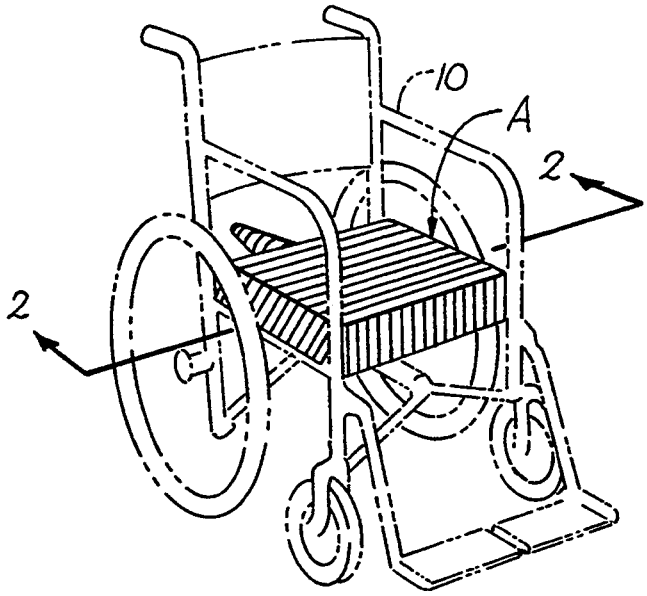
FIG. 1 is a perspective view illustrating a pneumatic cushion constructed according to the invention embodied in a wheel chair.

Referring now in more detail to the drawings, a pneumatic cushion A for reducing ischemic injury to a patient sitting in the wheel chair and the like is illustrated. As applied to a wheel chair, a support is provided by a wheel chair frame 10, and pneumatic cushion A is carried by the frame. Cushion A includes a dynamic, self-regulating air distribution system which periodically reduces air pressure in selected portions of the cushion. The air distribution system includes an air distribution plenum B having a plurality of air channels C. Plenum B includes a housing or plenum box 12 having a plurality of air compartments D formed in the box communicating with air channels C. The air compartments are arranged in an N×N matrix where N is the number of compartments D in a row. In the illustrated embodiment, there are five rows 14*a*–14*e*, each having five air sacks S.

The system includes an air distribution manifold F which extends centrally through air plenum box 12 with air channels C extending laterally from central air distribution manifold F. There are four major air channels 16, 18, 20, 22 extending from the manifold, as can best be seen in FIG. 2. Air distribution manifold F includes a cylindrical air distribution tube 24 which is a stationary member, and an air inlet 26 formed at a first end of the air distribution manifold which includes an annular disk 28 with a plurality of circumferentially spaced holes 30 for the entry of air. A center bearing 32 rotatably receives one end of a rotating program member which has a shaft 34. There is a fitting 36 carried by the air inlet for connection to a blower 38 for delivering air to the air inlet. An opposite end of shaft 34 is coupled to a clock motor 39 using a set screw 37 by which shaft 34 is rotated in a programmed manner.

Figure 2:
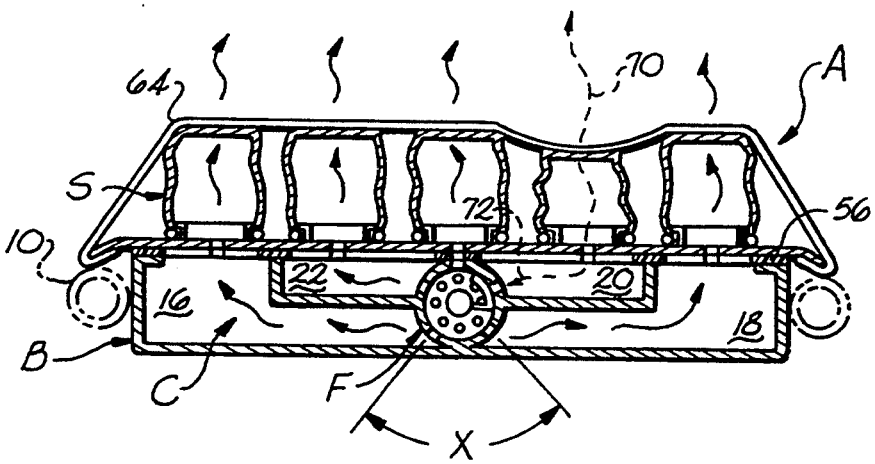
FIG. 2 is a sectional view taken along line 2—2 of FIG. 1.
Figure 3:
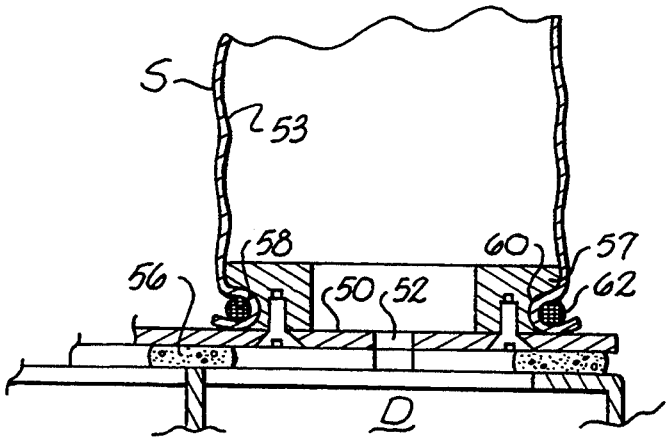
FIG. 3 is an enlarged sectional view of an individual air cell for a pneumatic cushion according to the invention.
Figure 4:
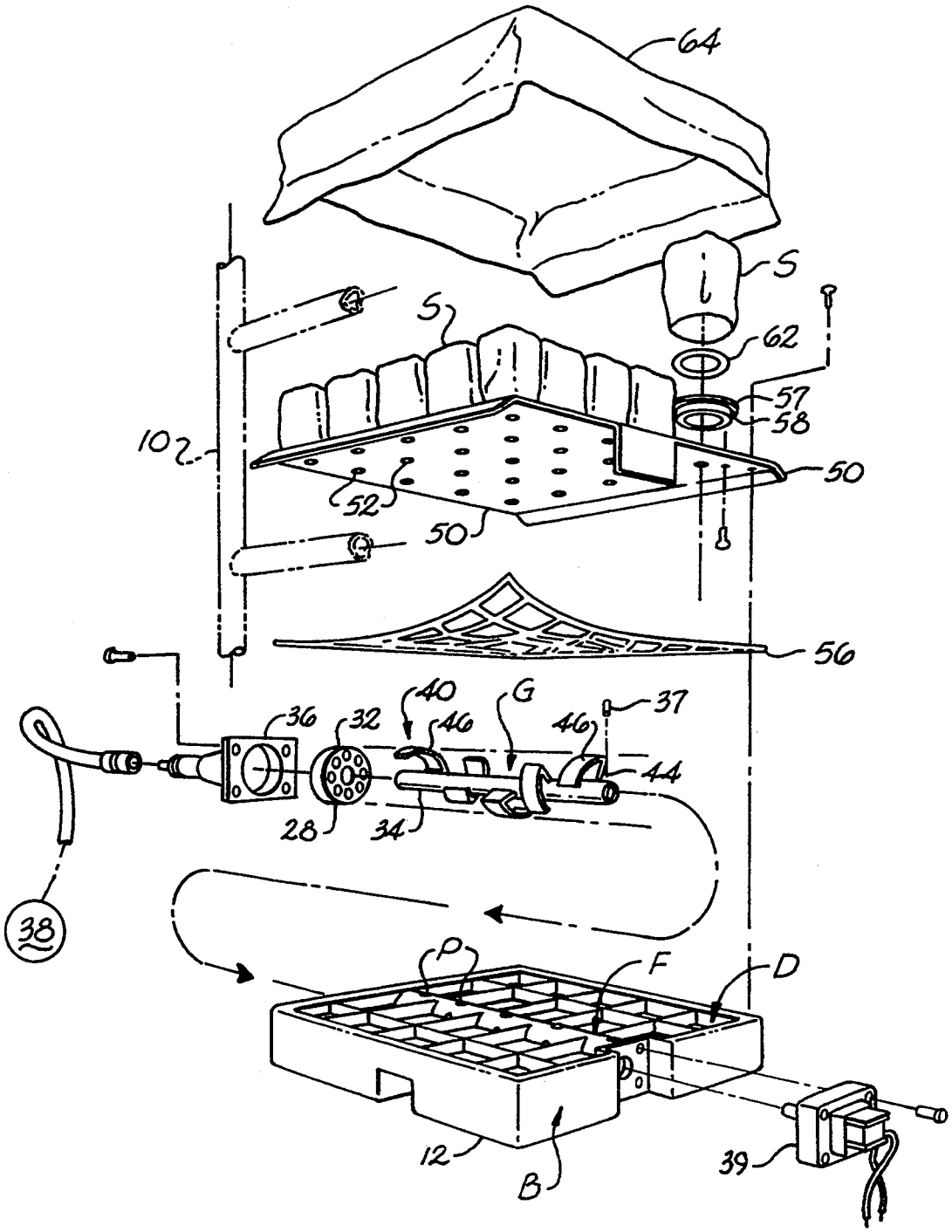
FIG. 4 is a perspective view with parts separated of a pneumatic cushion according to the invention.
Figure 6:
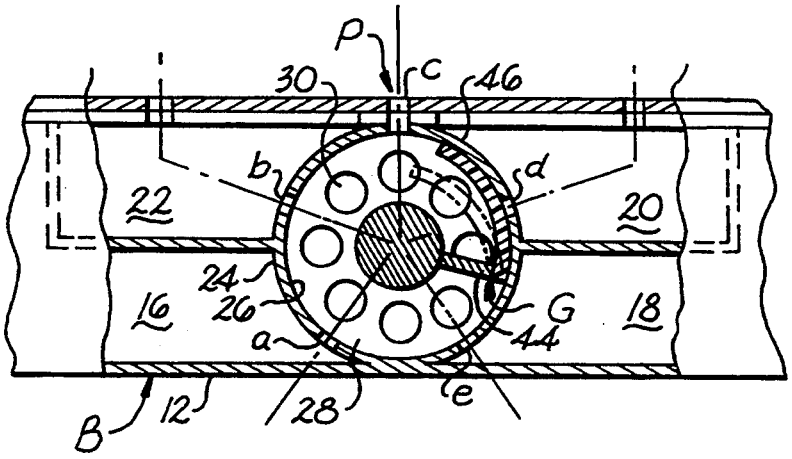
FIG. 6 is a sectional view taken through an air distribution manifold according to the invention.

As can best be seen in FIG. 6 and 4, there are a plurality of air distribution ports P in air distribution manifold F which are in fluid communication with air channels C in air distribution plenum B. The air distribution ports include air ports a, b, c, d, e spaced equiangularly around cylindrical air distribution manifold F. There are five sets of the port a-e along the length of the manifold as denoted 1–5. Where N is the number of rows, the angular spacing "X" of ports P is 360/N degrees around the circumference of cylindrical manifold F. In the illustrated embodiment, the five air ports for each row of air sacks have a 72 degree spacing circumferentially and are spaced a predetermined length longitudinally along manifold F (FIG. 2).

Air blocking means G is provided for periodically blocking air distribution ports P in the manifold to periodically interrupt the distribution of air in air channels C and deflate air sacks S in accordance with a preselected sequence. The air blocking means includes rotating program member 34 having rotating one-way valve means 40 with a blocking position in which the valve means is positioned over an air port P. In this position, valve means blocks air to deflate air sacks S while, at the same time allowing air to back flow in the system and vent from the air sack as where excessive pressure occurs from a person's shifting weight. The valve means includes flexible wipers carried at programmed positions on shaft 34 which block air distribution ports P. The wipers are angularly spaced from one another on said shaft with same spacing as between air ports, and same longitudinal spacing. Flexible wipers include a stem 44, and a flapper valve 46 which engages the inside diameter of cylindrical air distribution manifold F (FIG. 6). As can best be seen in FIG. 5, air sacks are deflated in diagonal rows from one corner to an opposite corner. Drive motor 39 carried by a second end of said air distribution manifold rotatably drives said rotating program member 34.

A top member 50 extends over the top of said air distribution plenum B having a plurality of air openings 52 in fluid communication with air channels C. There is an air opening over each air compartment D so that there are N×N air openings 52. Sealing means 56 in the form of a matrix gasket seals between air compartments D and top member 50, as can best be seen in FIGS. 4 and 2. Inflatable air sacks S are carried by top member 50 over air openings 52, and are deflated as air distribution ports P are periodically blocked in accordance with the preselected sequence shown in FIG. 5. In the illustrated embodiment, there are 5 sets of circumferentially spaced ports spaced along the length of manifold F, as can best be seen in FIG. 4. The air cells and sacks controlled by ports a–e are designated in FIG. 5. The air sacks are sequentially inflated and deflated for reducing ischemic injury to a person seated on the cushion. Air sacks S are constructed from a material 53 having a low air permeability to allow slight air escapement from the air sacks to relieve excessive pressure above and prevent accumulation of moisture between the cushion and occupant. For this purpose, it will be seen that the individual air sacks are unattached to act individually during inflation and deflation for proper support and relief to prevent ischemic injury. The fabric of the air sacks and cover is characterized in that the fabric is microporous, having a low transmission of air and water vapor, but which blocks liquid transmission. Suitable fabrics are constructed from a fine weave pattern, and either coated, laminated, or impregnated with a material such as expanded Teflon. Suitable fabrics are sold under the commercial names of Goretex which is manufactured by the W. L. Gore Company, Ultrex manufactured by Burlington Industries of Greensboro, N.C., and Storm Shed manufactured by Reeves Brothers Manufacturing Company of Gaffney, S.C.

A plurality of annular flanges 57 surround air openings 52 in top member 50 having an undercut 58 for receiving a lower edge 60 of the air sacks. An elastic retaining means 62 secures the lower edge of the air sacks underneath the undercut. A cover 64 extends over the plurality of air sacks S which is secured around the periphery of top member 50. Both air sacks S and cover 64 are preferably constructed from a low air permeable fabric which allows air to escape from the air sacks to dry moisture in the buttocks area of the person seated on the cushion through flow through the cover. It will be noted that the fabric maintains air for sufficient pressure to support the person during the inflation/deflation sequences, but bleeds air to prevent excessive pressure and moisture. The air pressure in the air sacks automatically adjusts to the shifting of weight of a patient on the cushion. An open air distribution path extends from the blower to the air sacks which are not blocked which allows the backwards flow of air from said air sacks to the blower in the event of over pressurization of the air sacks due to the weight of the patient. At the same time, the blocked air ports may be relieved through the open path by the flapper valves as shown in the direction of arrow 70, and the air sack fabric, having low air permeability, retains air during normal sitting pressures, but allows escapement of air outwardly in the event of excess pressure as shown by arrow 72.

Figure 7:
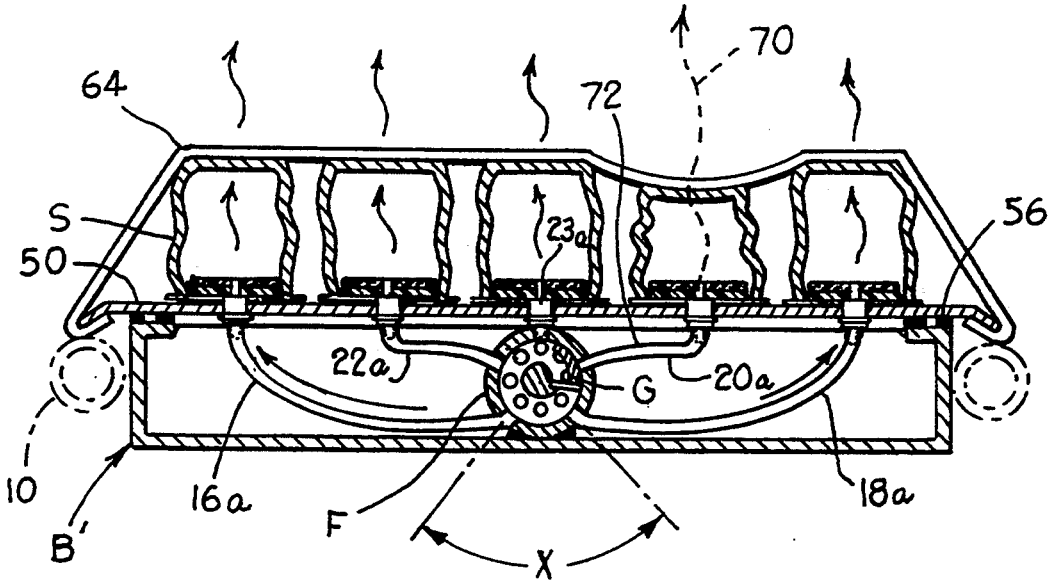
FIG. 7 is a sectional view of an alternate embodiment of a pneumatic air cushion according to the invention.
Figure 8:
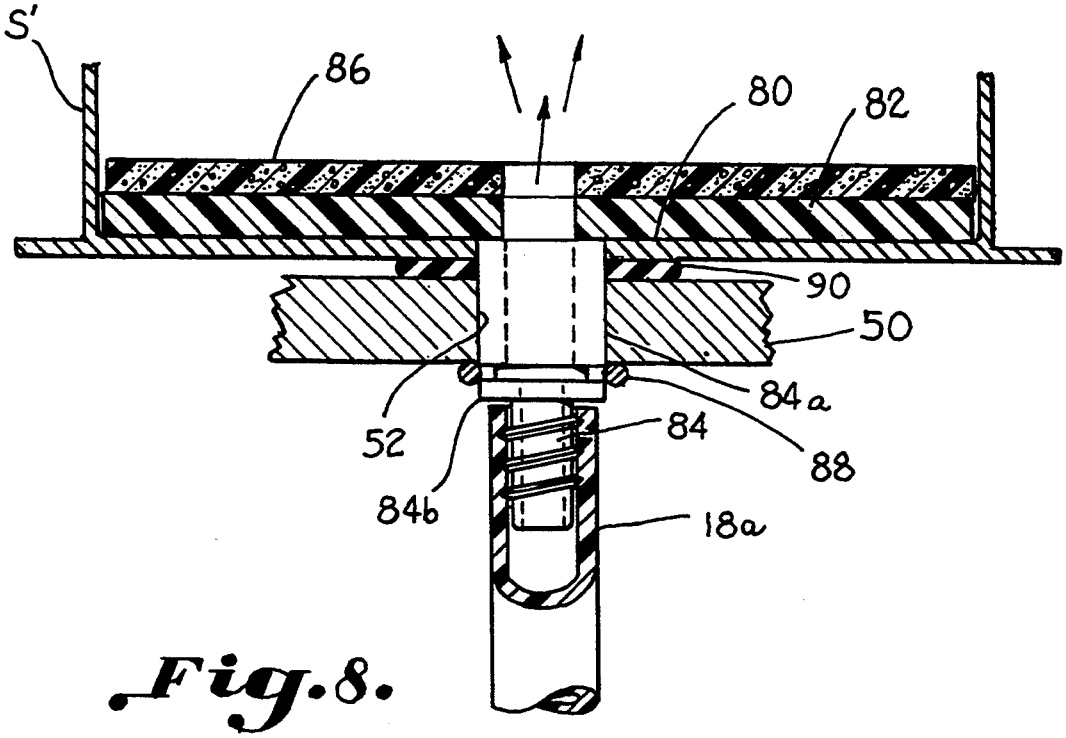
FIG. 8 is a sectional view illustrating the construction of an air sack according to the invention.
Figure 9:
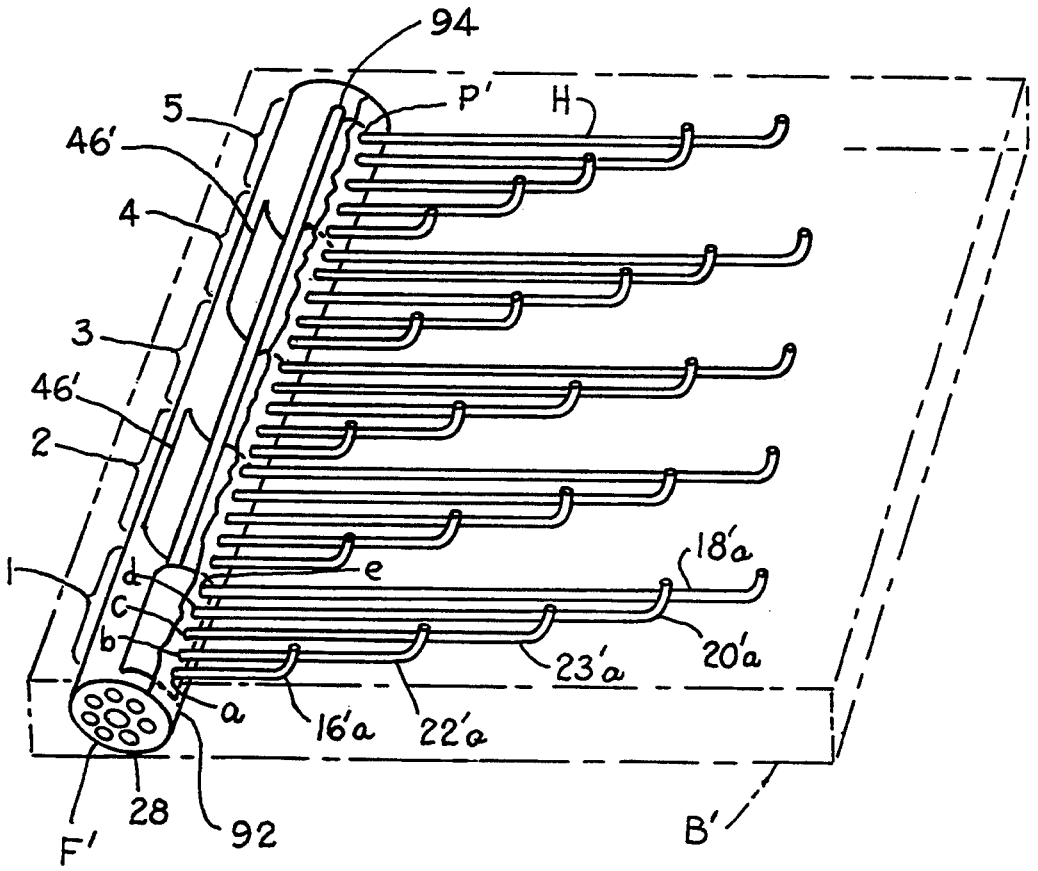
FIG. 9 is a perspective view showing an alternate embodiment of an air distribution manifold according to the invention.

Referring now to FIGS. 7 through 9, alternate embodiments of certain of the features of the invention will now be described. FIG. 7 illustrates a pneumatic cushion wherein the air distribution system utilizes flexible vinyl hose at 16*a*, 18*a*, 20*a*, 22*a*, and at 23*a*, if necessary. The flexible conduits may be any suitable flexible hose, such as vinyl, and are substitutes for air channels 16 through 22 formed by plates in the embodiment of FIG. 2. The vinyl hoses are connected to air distribution manifold F by suitable means, such as nipple fittings. The air distribution system and conduits are included in a plenum or housing B' covered by top member 50 having openings 52 as can best be seen in FIGS. 7 and 8. Air permeable air sacks S' are illustrated which include a fabric as in the embodiment of FIGS. 1 through 6 but with an alternate construction. The construction of air sacks S' comprises a fabric covering of low permeability fabric but which has a bottom wall 80. A generally rigid bottom plate 82 is sewn or otherwise constructed within the air sacks to include a stem 84 that provides a nipple fitting for the flexible conduits, as can best be seen in FIG. 8. A soft, foam pad 86 may be carried atop generally rigid plate 82 for comfort. Stem 84 includes a wide portion 84*a* and a flange 84*b* that provide a means of retaining the air sacks. For this purpose, a retaining ring 88 may be employed to retain bottom plate 82 and hence air sack S by means of engagement of top member 50 and flange 84*b*. A sealing ring 90 may be disposed between the bottom of the air sacks and top member 50 of housing B'.

FIG. 9 illustrates an alternate embodiment of a rotating air distributor according to the invention having a slightly different construction than that shown in FIG. 4 wherein a stationary member or stator 92 in the form of an elongated air distribution tube is provided. A rotor shaft 94 is carried within stationary member 92 and provides a rotary valve mechanism. A plurality of valving elements 46' are provided in a staggered and longitudinally spaced relationship. Ports P' are formed in the stationary member 92 and are alternately blocked and unblocked by valve members 46' in a cyclic manner. Valve members 46' are like valve members 46 in that they may have a rigid base and a flexible wiper 48'. Ports P' are arranged in sets or groups of five as shown by numerals 1–5. Each group of ports P' correspond to a row of air sacks. There are also five ports P' in each group. Rotor 94 is rotated in the same manner as rotor shaft 34 of FIG. 4. Each of the ports a through e are connected to openings 52 in top member 50 by the flexible conduits 16'*a* through 23'*a*. The air conduits, which go from the same port of stator 92 to the same air sacks, are given like reference numerals in the embodiments of FIGS. 9 and 7. While the air conduits are illustrated in parallel lines, it is to be understood that the air conduits are flexed and routed to stems 84 of the air sacks S' disposed in openings 52 in the rectangular array of FIG. 5.

Figure 5:
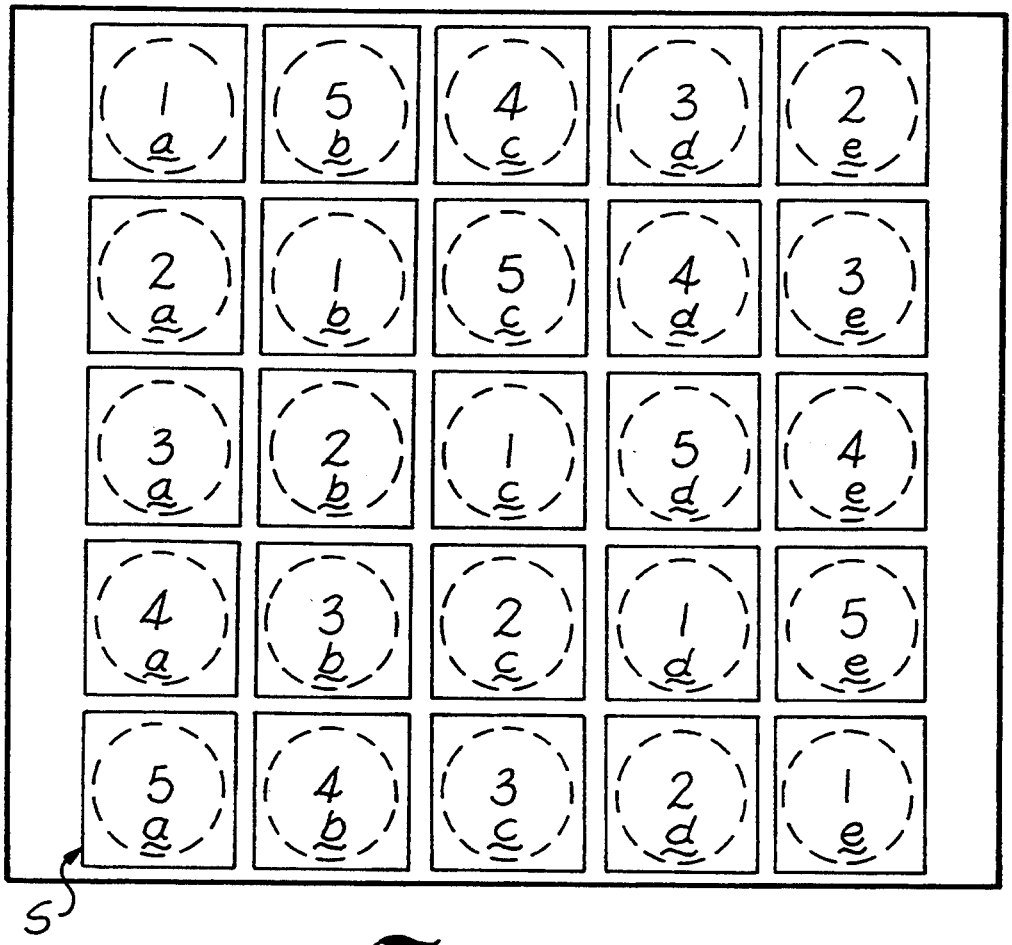
FIG. 5 is a top plan view of individual air sacks according to the invention illustrating a prescribed inflation/deflation sequence for relieving ischemic injury to the occupant.

The rectangular array includes N rows and M columns where N=M=5 in the illustrated embodiment of FIG. 5. However, it is to be understood that the array may include any number of rows and columns as is necessary for a chair or bed cushion. The illustrated array has five deflation cycles I–V. The number of ports (a–e) corresponds to the number of columns 90, and the number of sets of ports corresponds to the number of rows 92 in the matrix. However, the matrix does not have to be square, i.e. N=M.

Other variations of the distributor may be utilized in accordance with the present invention as long as the same is allowed to be maintained in a low profile box underneath the air sacks. For example, a stationary disk and a rotating disk may be utilized as the stator and rotor elements. The stator disk may have the ports formed therein in an analogous manner to that of the embodiments of FIGS. 2, 7 and 9 so as to group the ports and rows of air sacks as controlled by the distributor. A rotary element may be utilized to selectively block the ports in accordance with the deflation cycle and pattern shown in FIG. 5, or other suitable pattern.

Thus, it can be seen that an advantageous construction can be had for a pneumatic air cushion wherein the air blower delivers air at a constant flow rate and pressure which establishes a common system pressure in the unblocked air sacks, the air distribution conduits, and distribution manifold connected to the blower. The interruption of air flow to the blocked air sacks allows the air sacks to arrive at a pressure lost than the system pressure by escape of air through the air sack material and reach a stage of deflation, or equilibrium while remaining system stays at common system pressure. Air pressure in the air sacks changes for awhile as air is loss, and reaches a state of equilibrium depending on the weight, portion, and position of the body supported on the cushion. The new lower equilibrium pressure provides higher volume blood flow in the capillaries in the soft tissue overlying the cushion and air sacks. Thus, by creating this higher volume blood flow in a cyclic fashion, ischemic injury is reduced. The common system pressure may be determined primarily by the speed of the variable speed air blower.

While a preferred embodiment of the invention has been described using specific terms, such description is for illustrative purposes only, and it is to be understood that changes and variations may be made without departing from the spirit or scope of the following claims.

What is claimed is:

1. A pneumatic cushion for reducing ischemic injury comprising:

a supporting top member extending over an upper part of said cushion having a plurality of air openings;

a plurality of inflatable air sacks carried by said top member over said air openings, said air sacks being arranged in an rectangular array, where N is the number of rows and M is the number of columns in said rectangular array, and said air sacks are inflated and deflated in alternating inflation and deflation cycles according to a preselected sequence for reducing ischemic injury to a person supported on said cushion;

a dynamic air distribution system for distributing air to said air sacks and for periodically reducing air pressure in selected portions of said pneumatic cushion, said air distribution system comprising:

a continuous air supply which supplies air in a continuous manner generally at a common system pressure;

a plurality of air conduits connected to said air sacked, and said air conduits being in fluid communication with said air supply;

a rotary air distributor disposed in fluid communication between said air supply and said air conduits for controlling said air in said air conduits;

said rotary air distributor including a stationary element having a plurality of ports in fluid connection to said air conduits, and a rotary valve mechanism for periodically opening said ports during said inflation cycle in which said air sacks are inflated at said common system pressure, and blocking said ports to periodically interrupt the flow of air to said inflated air sacks during said deflation cycle in accordance with said preselected sequence;

said air sacks including an air permeable fabric which permits sufficient air escapement outwardly from said air sacks to deflate said air sacks during said deflation cycle when said valve mechanism is blocking said ports;

said stationary element having ports connected to said air sacks;

a cover secured to said housing extending over said plurality of air sacks; and a blower included in said air supply for delivering said air to said rotary air distributor.

2. The apparatus of claim 1 including a plenum box over which said top member extends.

3. The apparatus of claim 2 wherein said air conduits include a plurality of air channels formed by walls in said plenum box.

4. The apparatus of claim 2 wherein said stationary element includes a cylindrical air distribution tube extending underneath said top member connected to said air conduits.

5. The apparatus of claim 4 wherein said stationary element has M sets of N ports and, said rotary valve mechanism comprises a rotor shaft disposed coaxially with said cylindrical air distribution tube which carries N valving elements.

6. The apparatus of claim 5 wherein N=M.

7. The apparatus of claim 1 wherein said air conduits comprise flexible hose.

8. The apparatus of claim 1 including a fitting carried by said air inlet for connection to a blower which delivers air to said air inlet and rotary air distributor.

9. The apparatus of claim 1 wherein said ports are spaced 360/N degrees around a circumference of said stationary element.

10. The apparatus of claim 1 wherein said ports are arranged together on said stationary member corresponding to a prescribed row and said ports of different rows are arranged at different axial locations on said stationary element.

11. The apparatus of claim 10 wherein said rotary valve mechanism comprises a plurality of valve elements for blocking certain of said ports in different rows during a deflation cycle according to said prescribed sequence.

12. The apparatus of claim 11 wherein said valve elements are angularly spaced from one another on said shaft corresponding to said spacing between said ports, and said valve elements include flexible valve elements which engages an inside diameter of said stationary element to block said air ports and flex away from said ports to automatically relieve pressure in a blocked air cell.

13. The apparatus of claim 1 wherein said air sacks are constructed from a material having a low air permeability which allows slight air escapement from said air sack during said deflation cycle, and which relieve pressure in a generally self-regulating manner during said inflation cycle.

14. The apparatus of claim 1 wherein said air sacks comprises a fabric enclosure having a bottom wall, a rigid bottom plate carried within said sack over said bottom wall, said plate having a stem extending through said sack and said openings in said top member, and said air conduit being connected to said stem.

15. The apparatus of claim 14 comprising a sealing member disposed between said bottom wall of said air sack and said top member, and a retaining member for securing said stem within said opening of said top member.

16. The apparatus of claim 1 wherein said stationary member extends longitudinally underneath said top member having a longitudinal axis generally parallel to said top member, said stationary member being disposed near one side of said member, and said ports being arranged on a side of said stationary member opposite of said side of said top member, and said air conduits extending laterally from said stationary member to said air sacks.

17. A pneumatic cushion for reducing ischemic injury to a patient comprising:

a plurality of inflatable air sacks carried by a substrate which extends generally over a support area of said cushion;

a dynamic air distribution system for distributing air at a common system pressure to inflate said air sacks during an inflation cycle and for periodically reducing air pressure in selected ones of said inflated air sacks during a deflation cycle according to a predetermined sequence;

said air distribution system including an air blower establishing said common system pressure, an air distributor connected to said air blower, air conduits connected to said air distributor and to said air sacks, and said common system pressure being established in said air distributor, air conduits, and said inflated air sacks during said inflation cycle; and said air distributor including a valve mechanism disposed in said air distribution system having a blocking position which interrupts generally the entire communication of said common system pressure to said selected ones of said inflated air sacks during said deflation cycle;

said air sacks being constructed from a material having a low air permeability which allows a slight air escapement from said air sacks which allows said selected air sacks to reach an air pressure less than said common system pressure during said deflation cycle so that said pressure exerted against said patient's body is periodically reduced.

18. The apparatus of claim 17 wherein said valve mechanism has an open position in which said inflated air sacks remain generally at said common system pressure during said inflation cycle, and said open position of said valve mechanism allows said air in said inflated air sacks to flow in a reverse direction through said air distribution system and reduce the instantaneous air pressure therein in the event that air pressure in said inflated air'sacks exceeds said common system pressure so that said common system pressure is maintained in said inflated air sacks in a generally self regulatory manner during said inflation cycle.

19. The apparatus of claim 18 wherein said valve mechanism includes valves which block air flow through said ports in a first direction, but said valves open to deliver air through said ports in a second, opposite direction to automatically prevent excessive pressure in said selected air sacks.

20. The apparatus of claim 17 wherein said air sacks are arranged in a rectangular matrix comprising rows and columns, and said air sacks deflate diagonally from one corner of said matrix to another.

21. A pneumatic cushion for reducing ischemic injury to a person occupying said cushion comprising:

a support;

a pneumatic cushion carried by said support; a dynamic air distribution system which periodically reduces air pressure in selected portions of the cushion which includes means for producing an air flow, an air distributor for distributing said air flow;

a cyclic air flow controller for periodically blocking said air flow and interrupting the distribution of air in said air distributor;

a plurality of inflatable air sacks in fluid communication with said air distributor for receiving an inward air flow from said air distributor, and said air sacks are constructed from a material having a prescribed air permeability which allows an outward air flow through said air sack material;

said air flow controller having an open position in which said inward air flow is directed to said inflated air sacks during an inflation cycle to create said inflated air sacks; and said air flow controller having a blocking position for periodically blocking said inward air flow to said air sacks during a deflation cycle in accordance with said preselected sequence causing the air pressure in said air sacks to be reduced by said outward air flow so that reducing ischemic injury to a person seated on said wheel chair and moisture accumulation are reduced; and said air pressure in said selected air sacks being controlled by said person's anatomy and weight distribution when said air flow controller is in said blocking position during said deflation cycle said air sacks are arranged in a rectangular matrix comprising rows and columns, and said air sacks deflate diagonally from one corner of said matrix to another.

22. The apparatus of claim 21 wherein said air distribution means includes:

an air distributor having air conduits communicating with said air sacks, said air flow being delivered to said air distributor;

a cylindrical air distribution manifold;

a plurality of ports arranged in said cylindrical manifold in fluid communication with said air conduits of said air distribution plenum; and said air blocking means including a rotating program member for blocking said ports according to a predetermined program.

23. The apparatus of claim 21 wherein said air flow control means includes valve means having a blocking position in which said valve means blocks air through said ports in a first direction while delivering air through said ports in a second, opposite direction to automatically prevent excessive pressure in said air cushion.

24. A pneumatic cushion for reducing ischemic injury to a patient comprising:

a plurality of inflatable air sacks carried by a substrate which extends generally over a support area of said cushion;

a dynamic air distribution system for distributing air at a system pressure to said air sacks during an inflation cycle and for periodically reducing air pressure in selected ones of said air sacks during a deflation cycle according to a predetermined sequence;

said air distribution system including an air blower establishing said system pressure, an air distributor connected to said air blower, air conduits connected to said air distributor and to said air sacks, and said system pressure being established in said air distributor, air conduits, and a first plurality of said air sacks during said inflation cycle; and said air distributor including a valve mechanism disposed in said air distribution system having a blocking position for interrupting the communication of said system pressure to a second plurality of said preselected air sacks during said deflation cycle;

said air sacks being constructed from a material having a low air permeability which allows a slight air escapement from said air sacks which allows said second plurality of air sacks to reach an air pressure less than said system pressure during said deflation cycle so that said pressure exerted against said patient's body is periodically reduced; and said air sacks are arranged in a rectangular matrix comprising rows and columns, and said air sacks deflate diagonally from one corner of said matrix to another.

* * * * *